US006089559A

United States Patent [19]

Steinhilber

[11] Patent Number: 6,089,559

[45] Date of Patent: Jul. 18, 2000

[54] METHOD AND DEVICE FOR SEPARABLY DEPOSITING SHEETS IN A STACK

[76] Inventor: Friedhelm Steinhilber, Schauinelandwēg 13, 78628 Rottwell, Germany

[21] Appl. No.: 08/856,367

[22] Filed: May 14, 1997

[30] Foreign Application Priority Data

May 17, 1996 [DE] Germany ..... 196 19 995

[51] Int. Cl.[7] ..... B65H 39/02

[52] U.S. Cl. ..... 270/58.31; 270/58.05; 270/52.03

[58] Field of Search ..... 270/52.03, 58.31, 270/58.32, 58.05; 402/79, 80 P; 281/35; 283/40

[56] References Cited

U.S. PATENT DOCUMENTS

| | | | |
|---|---|---|---|
| 3,458,186 | 7/1969 | Schmidt | 270/58.31 |
| 3,794,550 | 2/1974 | Taillie | 402/79 |
| 4,624,452 | 11/1986 | Pulskamp | 270/58.31 |
| 4,784,508 | 11/1988 | Shannon | 402/79 |
| 5,020,786 | 6/1991 | Kimura et al. | 270/58.32 |
| 5,272,511 | 12/1993 | Conrad et al. | 270/58.31 |
| 5,316,279 | 5/1994 | Corona et al. | 270/58.31 |
| 5,709,374 | 1/1998 | Taylor et al. | 270/52.03 |

FOREIGN PATENT DOCUMENTS

| | | |
|---|---|---|
| 59-203060 | 11/1984 | Japan . |
| 62-4172 | 1/1987 | Japan . |
| 62-167170 | 7/1987 | Japan . |
| 62-185675 | 8/1987 | Japan . |
| 3-166164 | 7/1991 | Japan . |

*Primary Examiner*—William E. Terrell
*Assistant Examiner*—Patrick Mackey
*Attorney, Agent, or Firm*—Higgs, Fletcher & Mack LLP; Bernard L. Kleinke

[57] ABSTRACT

The device is disposed above an office machine stacking tray and stores circular divider films in a magazine. The divider films are selectively output singly from the magazine and deposited between successive sheet groups in the stacking tray to separate and identify the sheet groups.

13 Claims, 2 Drawing Sheets

METHOD AND DEVICE FOR SEPARABLY DEPOSITING SHEETS IN A STACK

TECHNICAL FIELD

The present invention relates in general to a method and device for separating sheets deposited in a stack. The invention more particularly relates to a method and a device for separably depositing sheets ejected by an office machine in a stack.

BACKGROUND ART

In numerous office machines such as printers, telecopiers, copying machines, etc., the printed sheets ejected by the office machine are deposited in a stack on an output tray for later retrieval. If successive sheets belonging to various processes or print jobs are deposited on the stack, the sheet groups corresponding to the individual processes are non-differentiated from one another. In order to obtain a desired sheet group for a particular print job, the sheets of the stack must be manually manipulated, or leafed through, to permit the individual sheets to be observed until the desired sheets are located within the stack. Such process requires a substantial amount of time and effort for obtaining the desired sheet group. This is the case, for example, where several work stations are connected to, and share, a common central printer.

It is known to attach a sorter comprising a multiplicity of stacking compartments on the sheet ejection side of an office machine so that the sheets associated with the various processes can each be deposited under control in separate stacking compartments. Such a sorter is complicated, requires much space and the number of available stacking trays and their holding capacities are limited. Furthermore, if the contents of the several stacking trays are removed together and transferred to a work station for further processing, the separated stacks are commonly combined in a single stack and must be separated again at the work station.

It is further known to insert paper sheets differing in color from the sheets of the stack between the sheet groups belonging to the various processes. The automatic insertion of the colored sheets is facilitated by storing the colored sheets in one of the trays provided in the office machine for the sheets to be printed.

Although the colored sheets within the stack enable the sheet groups to be ascertained visually, the output of the office machine is substantially reduced as the colored sheets occupy one of the storage trays of the office machine, and the number of available trays is limited. In addition, the colored sheets have the same format and dimensions as the sheets to be stacked. As a result, the colored sheets and the printed sheets are substantially aligned and the separation of the stack by means of the colored sheets is laborious. Furthermore, reusing the divided sheets is difficult as the colored sheets are exposed to the heat effect of the office machine printer mechanism.

It is also known to stack the particular successive sheet groups belonging to different processes such that successive sheet groups are offset alternately relative to each other (offset deposition). Through the use of relative offset deposition, the discrete sheet groups of the stack can be readily separated. However, when a sheet group corresponding to a particular process is removed from the stack, the two adjacent sheet groups originally disposed above and below the selected sheet group come into contact with one another. Due to the alternating offset deposition, the two adjacent sheet groups are not offset with respect to each other when engaged with one another, and they cannot be readily distinguished from each other.

Therefore, it would be highly desirable to have a new and improved method and device for separating groups of stacked sheets which enables the groups of stacked sheets to be readily distinguished from one another even when a selected group of sheets has been removed. Such a method and device should not substantially reduce the holding capacity of the associated office machinery, and should not be adversely affected by the heat effect of the office machine.

SUMMARY OF THE INVENTION

Therefore, the object of the present invention is to provide a new and improved method and device for separably depositing sheets in a stack, wherein groups of stacked sheets can be readily distinguished from one another even after a selected group of stacked sheets is removed from the stack. Such a method and device does not reduce the holding capacity of the office machinery, and is not adversely affected by the heat effect of an office machine.

Briefly, the above and further objects of the present invention are realized by providing a new and improved device for separably depositing sheets in a stack which can readily and conveniently separate sheet groups in a stack according to a novel method of the present invention.

The device is disposed above an office machine stacking tray and stores circular divider films in a magazine. The divider films are selectively output singly from the magazine and deposited between successive sheet groups in the stacking tray to separate and identify the sheet groups.

The underlying inventive idea resides in disposing on the office machine an additional magazine for divider films to separate different print jobs from one another in a single stack of print jobs output by the office machine. The divider films are output singly from the magazine and are deposited on the sheet stack output by the office machine. Since the magazine for the divider films is disposed separately on the office machine, the dimensions of the divider films can be selected independently of the sheet transport and the sheet format of the office machine. The dimensions of the divider films are selected such that they, at least in one dimension, are larger than the sheets output by the office machine. The divider films therefore project from the edge of the sheet stack. In this way, the divider films can be grasped readily, and the groups of print jobs can be readily separated from the sheet stack, by lifting the divider films within the stack. By means of the divider films, the entire stack can be leafed through, sheet group by sheet group, in order to find the desired sheet group.

If a sheet group disposed in the stack is required, the sheet group can be pulled out of the entire stack together with the associated divider film. The remaining divider films stay in the stack and continue to separate the successive remaining sheet groups. The divider film removed with the selected sheet group from the stack can be placed back into the magazine so that it is available for further use. It is also advantageous that the entire stack, together with the divider films, can be removed from the stacking tray of the office machine and be transferred to the place at which they are further processed, for example to a work table. There, the various sheet groups can be separated and stapled, distributed, placed into envelopes or they can be inserted into signature folders, etc. The divider films are subsequently returned to the office machine and placed into the magazine for reuse.

Inserting the divider film into the deposited sheet stack has the further advantage that the entire space available for depositing the sheets can be utilized. The different sheet groups separated one from the other by the divider films are disposed in a single stack, and occupy only the actually required space. Unused intermediate gaps, such as is found in sorters due to incompletely filled stacking compartments and the free space required for the ejection of the sheets into the compartments, is not found.

The device has an extremely simple structure since it requires only a magazine into which the divider films are loosely placed, as well as a simple output unit which outputs the divider films individually from the magazine. The divider films can be inserted from the magazine into the paper path of the office machine so that they are transported via the sheet output of the office machine into the sheet stacking tray. However, the device is preferably disposed above the sheet output of the office machine so that the output divider films are placed from above onto the sheet stack without additional guide devices. The device can, in particular, also be implemented as a simple attachment apparatus which can be optionally installed on the office machine.

The magazine is preferably implemented to enable removed divider films to be readily placed back into the magazine. The magazine comprises for this purpose a receptacle open in the upward direction into which the divider films are placed.

The divider films can have different shapes and their dimensions with respect to the sheets processed by the office machine can be selected such that the divider films project from the stack of the sheet groups in the sheet stacking tray of the office machine. It is useful if the divider films have rounded-off corners which, in the event of multiple use of the divider films, are less subject to damage. In a preferred embodiment, the divider films are formed as circular or oval disks whose diameter is somewhat larger than the narrow side of the sheets ejected from the office machine. The circular shape of the divider film has the advantage that the divider films can be returned to the magazine of the device after they have been used without an orientation or alignment in the magazine being required.

The divider films can comprise any suitable material, for example a paper of suitable stiffness, thin cardboard or synthetic material. The divider films must only meet a few basic requirements. The stiffness of the divider films must be sufficient for them to project beyond the edge of the stack making possible the lifting of the stack by means of the divider films so that it is possible to leaf through the stack. The divider films must, on the other hand, be sufficiently pliable to make possible the simple detachment and pulling of individual sheets from the magazine and not prevent bending the stack when leafing through it. Since the divider films are used several times, they should have sufficient resistance to permit their use over a relatively long period of time.

It is useful if the divider films are transparent in order to permit ready identification of the documents underneath them. To facilitate recognition of the divider films in the stack, the divider films, or at least the margin region projecting from the stack, can be colored. Since the divider films are usable over a long time and since the user sees them daily and frequently, the divider films are especially suitable for imprinting on them information or advertisement.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
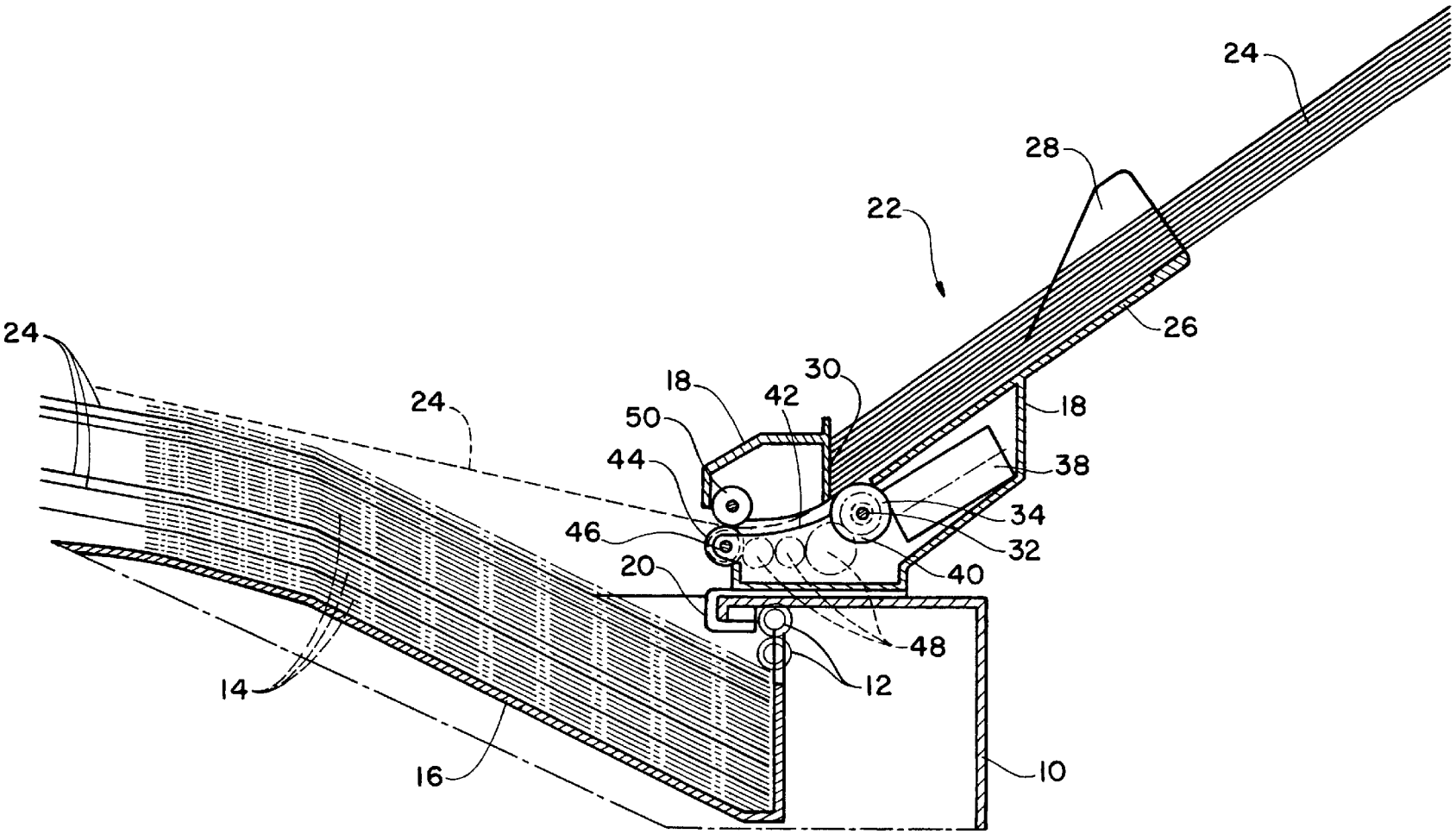
FIG. 1 is vertical section through the device installed on a printer, and which is constructed in accordance with the present invention.
Figure 2:
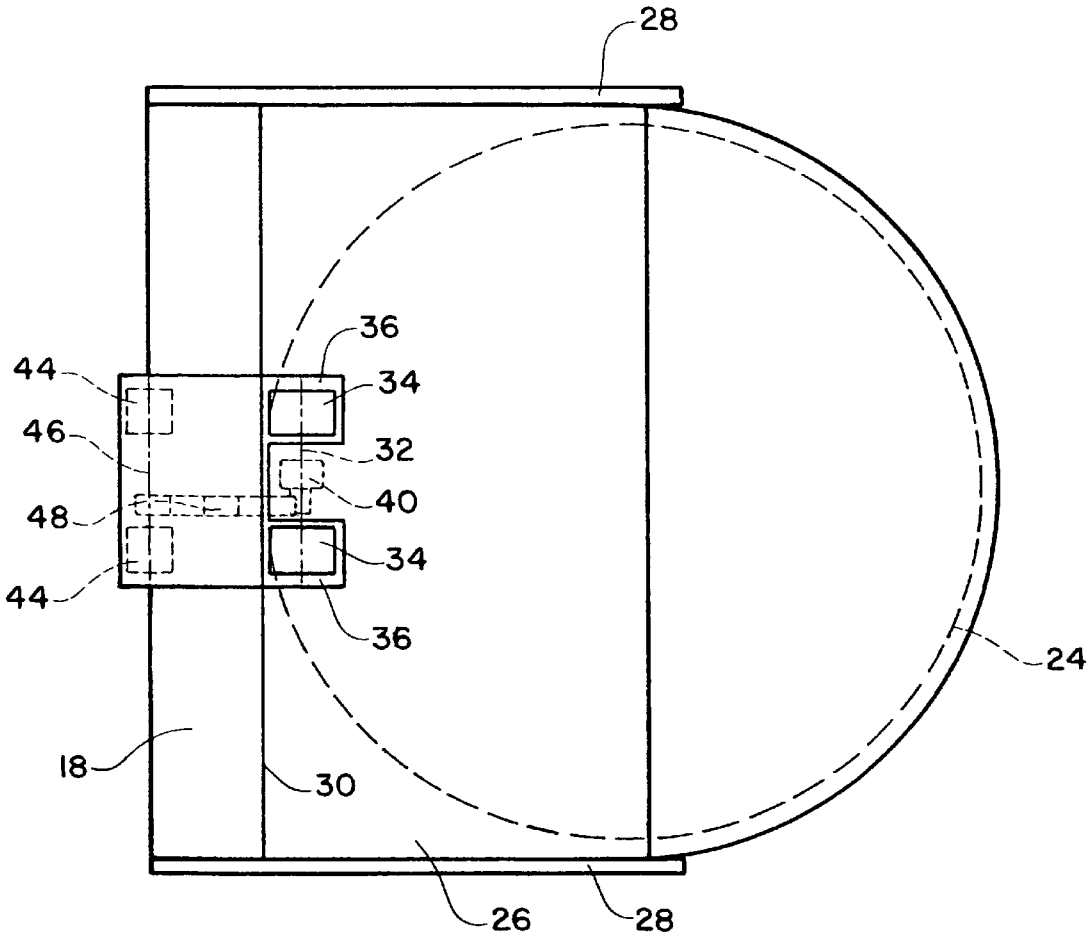
FIG. 2 is a plan view of the device of FIG. 1.

The output region of a printer 10, for example a laser printer, is shown in FIG. 1 having output rollers 12 which eject printed sheets 14 and deposit them stacked in a tray 16. The printer 10 is commercially available and will not be described hereinafter in greater detail.

The device according to the invention is placed above the output rollers 12 onto the upper cover plate of the printer 10. The device comprises a housing 18 resting on the cover plate of the printer 10, and attached thereto with clips 20 encompassing the cover plate. At the top of the housing 18 is a magazine 22 into which pliable divider films 24 are received and stacked. The divider films 24 are preferably circular disks constructed from a suitable synthetic material and which have a thickness such that they have a specific inherent stiffness yet can be bent under slight pressure. The diameter of the divider films 24 is greater than the width of sheets 14.

The divider films 24 can have a shape other than a circle and still function as desired where at least one dimension of the divider films 24 exceeds the corresponding dimension of the printed sheets 14. An outer band 33 on the divider films 24 can be colored to facilitate distinguishing the divider films 24 from the printed sheets.

The transparent central portion of the divider films 24 enables the sheet groups to be easily identified. Use of a contact transparent material enables the printed sheets 14 to be viewed when the divider sheets 24 are substantially in contact with the printed sheets 14, yet substantially limits the observation of the printed sheets 14 when the divider films 24 are removed from the printed sheets 14.

The magazine 22 includes a bearing surface 26 formed onto the upper side of the housing 18 and extending from the housing 18 in the rearward direction and inclined at a constant angel of slope therefrom. At the two side edges of the bearing surface 26 are guide side plates 28 projecting perpendicularly in the upward direction. The width of the bearing surface 26, i.e. the clear distance of the guide side plates 28, corresponds substantially to the diameter of the divider films 24 while the length of the bearing surface 26 is at least greater than the radius, and preferably about equal to, the diameter of the divider films 24. The divider films 24 can thus be stacked loosely one on top of the other in the magazine 22 wherein they are supported by the bearing surface 26 and guided laterally by the guide side plates 28. At the lower front transverse edge of the magazine 22 is a vertical stop wall 30 for supporting the stacks of the divider films 24 and for preventing them from sliding forward on the inclined bearing surface 26.

Below the lower front edge of the bearing surface 26 is a horizontal shaft 32 rotatably supported in the housing 18 and extending parallel to the stop wall 30. On the shaft 32 are two torsion-resistant separating rollers 34 extending with their adhering circumference through apertures 36 bordering the stop wall 30 at the front edge of the bearing surface 26. As is evident in FIG. 1, the circumference of the separating rollers 34 projects slightly beyond the surface of the bearing surface 26 to engage the lowermost divider film 24 on the bearing surface 26. The shaft 32 with the separating rollers 34 is drivable via a worm gearing 40 by an electric motor 38 supported under the bearing surface 26 in the housing 18. The driving of the separating rollers 34 in the representation of FIG. 1 takes place in the counter clockwise direction. Beginning at the lower transverse edge of the stop wall 30 is a throughput channel 42 extending over the entire width of the bearing surface 26, having a height greater than a single thickness and smaller than a twofold thickness of the divider films 24, and which is aligned with the upper side of the bearing surface 26.

The throughput channel 42 starts with the angle of slope of the bearing surface 26 and extends under a slight curvature into a substantially horizontal angle of slope through the housing 18. The output end of the throughput channel 42 terminates at the vertical front face of the housing 18 disposed above the edge of the upper cover plate of the printer 10, which edge covers the output rollers 12. On the underside of the output end of the throughput channel 42 are two lower ejection rollers 44 centrally disposed on a shaft 46. The shaft 46, and thus the lower ejection rollers 44, are driven via a toothed gearing 48 by the shaft 32, and thus by the electric motor 38. The direction of rotation of the lower ejection rollers 44 is the same as the direction of rotation of the separating rollers 34, i.e. in the representation of FIG. 1 this is the counter clockwise direction. Above the output end of the throughput channel 42 are upper ejection rollers 50 supported in the housing 18 so as to be freely rotatable. The rollers 50 are under spring load from above to facilitate engaging the divider films 24 between the rollers 50 and the lower ejection rollers 44.

When the printer 10 is in operation, the printed sheets 14 are ejected via the output rollers 12 and deposited in stacks in stacking tray 16. When an associated printing process or print job is completed and the group of sheets 14 belonging to this process are deposited in stacks in the stacking tray 16, the device receives a start signal which starts the electric motor 38. The electric motor 38 drives the separating rollers 34 and the lower rejection rollers 44. The separating rollers 34 engage frictionally from below the lowest divider film of the divider films 24 stacked in the magazine 22 and urges it through the throughput channel 42. Since the height of the throughput channel 42 is smaller than the two-fold thickness of the divider films 24, only one divider film 24 can be pushed through the throughput channel 42 at one time. The divider film 24 is transported to a region between the lower ejection rollers 44 and the upper ejection rollers 50 and is grasped thereby. The divider sheet 24 is further transported in friction fit by the lower ejection rollers 44, as is shown in FIG. 1 in dashed lines. As soon as the divider film 24 has completely passed through the ejection rollers 44 and 50, the divider film 24 falls freely in the downward direction and comes to lie on top of the stack of sheets 14. The electric motor 38 is subsequently stopped.

The printer 10 can now start with the next print job. After this succeeding print job is completed, the next divider film 24 is placed on the stack in a corresponding manner. The divider films 24 inserted into the stack of the sheets 14 and deposited in stacking tray 16 project, as is shown in FIG. 1, beyond the edge of the stack due to their greater diameter. The projecting edge of the divider films 24 can be readily grasped in order to lift the particular divider film 24 and the corresponding portion of the entire sheet stack. This permits inspecting the sheets 14 disposed under the raised divider film 24. Any desired sheet group in any position can be removed from the stack. It is only necessary to lift the appropriate divider film 24 and the desired sheet group can be taken out together with the associated divider film 24.

The divider films 24 no longer required after the removal from the stacking tray 16 are simply placed back into the magazine 22 on top of the stack of the divider films 24 stored therein. The lateral guide side plate 28 and the slope of the bearing surface 26 help position the divider films 24 placed in the magazine 22 so as to be congruent. Because of the circular shape of the divider films 24, special alignment procedures or devices are not required.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A device for separably depositing sheets ejected from an office machine having an output tray in a sheet stack, the office machines ejecting the sheets from a sheet output in an output paper path, the output paper path being the course the sheets follow from the sheet output until the sheets are deposited on the sheet stack comprising:

at least one reusable divider film for separating the stack of deposited sheets into sheet groups corresponding to individual print jobs;

said at least one reusable divider film having at least one dimension exceeding the corresponding dimension of the deposited sheets to enable said divider film to extend beyond the stack for facilitating the identification of each sheet group;

magazine means coupled to the office machine at about the output tray for storing said at least one reusable divider film and for selectively depositing said at least one reusable divider film on the sheet stack to separate the individual print jobs for facilitating the selective retrieval of the individual print jobs from the sheet stack, wherein said reusable divider film is retrieved from the sheet stack and returned to the magazine; and mounting means for positioning said magazine means on the office machine above and opposite to the sheet output so that the at least one reusable divider film is ejected from the magazine at a position above the sheet output and is urged generally in the same direction as the output paper path before being deposited on the sheet stack.

2. A device according to claim 1, wherein said at least one reusable divider film is transparent.

3. A device according to claim 2, wherein said at least one reusable divider film is contact transparent.

4. A device according to claim 1, wherein said at least one reusable divider film is circular.

5. A device according to claim 1, wherein said at least one reusable divider film has an outer colored band.

6. A device according to claim 1, wherein said magazine means includes clip means for securing said magazine means to the office machine at about the output tray.

7. A device according to claim 1, wherein said magazine means includes a housing having an upwardly inclined bearing surface for supporting said at least one reusable divider film, a substantially vertical stop wall disposed at about a lower edge of said bearing surface for retaining said at least one reusable divider film on said bearing surface, and a throughput channel extending from about said stop wall through said housing to an output end above the output tray for transporting selectively said at least one divider film from said bearing surface to the output tray.

8. A device according to claim 7, wherein said throughput channel extends across substantially the entire transverse width of said bearing surface and defines an opening having a height greater than the thickness of an individual divider film and smaller than the thickness of two of said divider films to help control the deposition of said reusable divider film on the stack.

9. A device according to claim 7, further including a pair of spaced apart guide placed extending upwardly from said bearing surface for guiding said at least one reusable divider film to said throughput channel.

10. A device according to claim 7, further including separating roller means projecting above said bearing surface for engaging a lowermost reusable divider film, and a motor means coupled to said separating roller means for activating said separating roller means to transport said lowermost reusable divider film through said throughput channel and onto the stack to help a corresponding print job.

11. A method for separably depositing sheets ejected from an office machine having an output tray in a stack, comprising:

using at least one reusable divider film and a magazine for storing and depositing said divider film on the stack, said reusable divider film having at least one dimension larger than a corresponding dimension of the deposited sheets;

disposing said magazine on the office machine above the output tray;

supporting said reusable divider film at an upwardly inclined angle with a bearing surface;

preventing said reusable divider film from sliding downwardly off of said bearing surface;

selectively engaging a lowermost reusable divider film to transport it through a throughput channel;

transporting said lowermost reusable divider film through said throughput channel, above and oppositely disposed to an output paper path and generally in-line with the output paper path for depositing said lowermost reusable divider film on the stack to help identify an individual print job; and receiving said lowermost reusable divider film on the stack, wherein said lowermost reusable divider film extends beyond the stack to facilitate identification of the corresponding print job; and removing a desired print job and its associated reusable divider film from the stack, and returning said associated reusable divider film to said magazine for reuse.

12. A method according to claim 11, further including using transparent divider film, and observing said individual print job through said divider film to ascertain the identity of said print job.

13. A method according to claim 11, further including restricting the transportation of divider films through said throughput channel to a single divider film only.

* * * * *